United States Patent [19]

Kim

[11] Patent Number: 4,828,466

[45] Date of Patent: May 9, 1989

[54] OIL FEEDING MEANS INCORPORATED IN A HORIZONTAL TYPE ROTARY COMPRESSOR

[75] Inventor: Keum M. Kim, Inchon, Rep. of Korea

[73] Assignee: Daewoo Electronics Co., Ltd., Seoul, Rep. of Korea

[21] Appl. No.: 137,432

[22] Filed: Dec. 22, 1987

[51] Int. Cl.[4] ..... F04C 29/02; F01M 1/02; F01M 11/02

[52] U.S. Cl. ..... 418/88; 418/94; 418/150; 184/6.16

[58] Field of Search ..... 418/63, 88, 94, 150; 184/6.16

[56] References Cited

U.S. PATENT DOCUMENTS

| | | | |
|---|---|---|---|
| 4,568,253 | 2/1986 | Wood | 418/94 |
| 4,624,630 | 11/1986 | Hirahara et al. | 418/63 |
| 4,626,180 | 12/1986 | Tagawa et al. | 418/63 |

*Primary Examiner*—John J. Vrablik
*Attorney, Agent, or Firm*—Ladas & Parry

[57] ABSTRACT

A horizontal type rotary compressor incorporating an oil feeding means comprises, in a casing, a lubricant reservoir retaining the lubricating oil, a compression section, a horizontally disposed electrical motor and a frame incorporating a journal-bearing in the middle thereof for supporting the shaft of the electric motor directly connected to the said compression section. The oil feeding means comprises an oil flow passage which is formed inside the said frame and lower part of which extends below the surface of the oil, an annular space formed between the journal-bearing and the shaft to communicate with the said oil flow passage and oil supply grooves formed on the periphery of the shaft to communicate with the annular space wherein the said oil supply grooves extends to the outside of the sliding portion of the axis to be exposed to the inside of the casing and the depth of the oil supply grooves is limited below the value, h, represented by the relationship.

$$h = \left( \frac{6\mu\omega R}{\rho g H} \cdot \cot\theta \cdot L \right)^{\frac{1}{2}}$$

where $\mu$ is viscosity of refrigerant, $\omega$ is angular velocity of shaft, R is radius of shaft, $\rho$ is density of lubricant, g is acceleration of gravity, H is distance from surface of lubricant to sliding surface of journal-bearing, $\theta$ is angle between groove and axial line of shaft and L is total length of shaft where grooves are formed.

4 Claims, 4 Drawing Sheets

OIL FEEDING MEANS INCORPORATED IN A HORIZONTAL TYPE ROTARY COMPRESSOR

TECHNICAL FIELD

The present invention relates to a horizontal type rotary compressor, more particularly, to an oil feeding means of a horizontal type rotary compressor incorporated into a refrigerator, an air-conditioner, or the like.

BACKGROUND OF THE INVENTION

Recently, the horizontal type rotary compressor has been increasingly employed in various types of equipment and therefore, the actual demand for the compressor has been drastically increasing.

The horizontal arrangement of such rotary compressor begets such advantages as saving of installation space, the decrease of vibrations and noises, etc, but requires a separate oil feeding means in order to supply lubricating oil to the sliding portion of a rotating shaft while the level of lubricating oil surface remains low enough to prevent the horizontally positioned rotor portion of a motor from being submerged in the oil. The oil feeding means of conventional rotary compressors may be divided into, for example, the coiled spring pump type as schematically shown in FIG. 5, the fluid diode type as shown in FIG. 6 and the pressure difference type as shown FIG. 7. First, the coiled spring pump type shown in FIG. 5, and as cited in U.S. Pat. No. 4,626,180 as prior art, has a curved oil feeding pipe which is immersed in oil stored in the lower part of a casing. The oil feeding pipe is provided therein with a coiled spring which rotates with a crankshaft. The oil is transferred to the end portion of the crankshaft which is closer to the coiled spring through the leads of the coiled spring. Secondly, the fluid diode type shown in FIG. 6, as disclosed in U.S. Pat. Nos. 4,543,046, 4,544,338 and 4,626,180, includes an oil feeding hole defined inside the shaft provided with oil grooves on the peripheral surface thereof, a fluid diode type oil feeding pump activated by the shaft and a pipe interconnecting the said pump with the said oil feeding hole. However, the oil feeding means adopting the fluid diode method and the coiled spring pump method has certain disadvantages. The configuration thereof is complicated, due to the inclusion of various parts, and the volume of the compressor unit as well as the production cost is increased. Consequently, the possibility of malfunction of the compressor becomes higher and also the life span thereof is shorter. Lastly, the pressure difference type device shown in FIG. 7 and as disclosed in Japanese laid-open patent publication No. 62-58086, comprises, in a casing, an annular space (5) formed between a journal-bearing and a grooved shaft(2), an oil passage(1*b*) the lower end of which is extended below the oil surface and the higher end of which communicates with the said annular space(5). The annular space(5), the oil passage(1*b*) and the groove(2*a*) on the shaft form a sealed space isolated from inner space of the casing. Upon the operation of the compressor unit, the oil stored in the lower part of the casing can be supplied to the sliding portion of the shaft via the sealed space due to the pressure difference between the pressure within the casing and the pressure in the said sealed space. Although the configuration of the pressure difference type oil feeding means is simpler than those of the aforesaid other types, the supply of the oil by this oil feeding means is delayed and the oil feeding to the partial sliding portion where the oil supply groove is not formed is dissatisfactory. Further, the pressure difference type device sometimes malfunctions because the oil cannot be delivered up to the said sliding portion since the pressure difference required to raise the oil cannot be attained within the compressor. The oil feeding means utilizing pressure difference will be described in more detail. A spiral oil groove(2*a*) is formed only on the inner part of the sliding portion of the shaft(2) so that the said sealed space comprising the oil passage(1*b*), the annular space(5) and the groove(2*a*) can be isolated from the other space within the casing(4). Therefore, the pressure in the sealed space can be affected via the lubricant(9) only by the increased pressure within the casing(4) upon the operation of the compressor. Thus, when the compressor starts, via the oil flow passage(5) the lubricant(9) is forcibly delivered by the increased pressure within the casing(4) up to the annular space(5) and to the sliding portion between the shaft(2) and the journal bearing(1*b*) maintaining the same pressure as before the start of the compressor. Since the sealed space has been occupied by the refrigerant gas, the refrigerant gas is compressed to a certain pressure, which hinders the lubricant from flowing into the said sealed space. Therefore, a larger pressure difference is required to make the lubricant surely reach the sliding portion of the shaft. For these reasons, the supply of the lubricant to the said sliding portion may be delayed and, furthermore, the supply of the lubricant to the said sliding portion may not be accomplished because the required pressure difference is not formed. On the other hand, since the oil groove is formed on the inner part of the sliding portion of the shaft, the lubricant cannot be delivered sufficiently to the outer sliding portion where the oil groove is not formed. As a result, the sliding portion of the shaft is easily abraded and, therefore, the life span of the compressor is remarkably shortened. In order to overcome this problem, anti-compression agents are sometimes added to the lubricant, but these merely result in the increase of the production cost of the compressor. In addition, as mentioned above, since the oil groove is formed partially on the sliding portion of the shaft to keep the said closed space gas-tight, if micro-chips or other hard dirts are delivered with the lubricant into the said sliding portion, such foreign objects will intervene in the sliding portion between the journal-bearing and the shaft. Since they cannot escape from the said sliding portion, the result will be the mechanical locking of the shaft and journal bearing resulting is the fatal malfunction of the compressor and/or the undesirable formation on deep scratches on the sliding portion. Consequently, in order to prevent those problems, the perfect cleaning of parts before assembling of the compressor as well as the precise control of the foreign materials in the lubricant is required, which results in the increase of the production cost of the compressor.

THE OBJECT OF THE INVENTION

Accordingly, the object of the present invention is to provide an oil feeding means incorporated in a horizontal type rotary compressor, which enables the lubricating oil to be supplied promptly and reliably and particularly enables the lubricant to be supplied evenly to the whole sliding area of the shaft.

Another object of the present invention is to provide an oil feeding means which can be manufactured without serious consideration of the perfect cleaning of parts of the compressor and the precise control of the foreign objects in the lubricant.

A further object of the invention is to provide an oil feeding means which has a simple configuration and can be produced easily.

SUMMARY OF THE INVENTION

The above-mentioned objects can be accomplished by providing a horizontal type rotary compressor comprised of a casing having an oil sump in the bottom thereof, a compressor section, a horizontally disposed electric motor, a frame incorporating a journal bearing in the middle thereof are supporting the shaft of said motor, said shaft working said compression section, an oil flow passage vertically formed in said frame, the lower part of said oil flow passage opening into said oil sump, an annular space formed between said journal bearing and said shaft to communicate with said oil flow passage, and oil supply grooves formed helically in the periphery of said shaft to communicate with said annular space, characterized in that said oil supply grooves extend substantially over all the shaft portions which slide in the journal bearing, said oil supply grooves opening into said casing, their depths being limited to a value below that of H represented in the following relationships.

$$h = \left( \frac{6\mu\omega R}{\rho g H} \cdot \cot\theta \cdot L \right)^{\frac{1}{2}}$$

where $\mu$=viscosity of refrigerant
$\omega$=angular velocity of shaft
R=radius of shaft
$\rho$=density of lubricant
g=acceleration of gravity
H=distance from surface of lubricant to sliding surface of journal-bearing
$\theta$=angle between groove and axial line of shaft
L=total length of shaft where grooves are formed.

In the oil feeding means incorporated in a horizontal type rotary compressor in accordance with the present invention, the pumping action of the oil grooves by the force of inertia due to the rotation of the shaft and the laminar flow of the refrigerant gas built up between the grooves and the inner periphery of the journal-bearing cause the refrigerant captured within the grooves, the annular space and the oil flow passage to flow out in spite of the increasing pressure within the casing upon the start of the compressor. Accordingly, the lubricant stored in the lower part of the casing follows the refrigerant to be delivered to the grooves via the oil flow passage and the annular space. Thereafter, the lubricant can continuously be delivered to the grooves by the pumping action of the grooves due to the rotation of the shaft regardless of the elevated pressure within the casing.

Furthermore, since the grooves on the periphery of the shaft are extended to be exposed to the outside of the sliding portion, the microchips and/or the hard foreign materials mixed in the lubricant can be easily discharged from the groove together with the lubricant. Therefore, the mechanical locking of the shaft and the bearing can be prevented and the damage of the peripheral surface thereof can be minimized.

BRIEF DESCRIPTION OF THE DRAWINGS

The present invention will now be described in more detail with reference to the exemplifying embodiment thereof illustrated in the accompanying drawings, in which.

DETAILED DESCRIPTION OF THE PREFERRED EMBODIMENT

Figure 1:
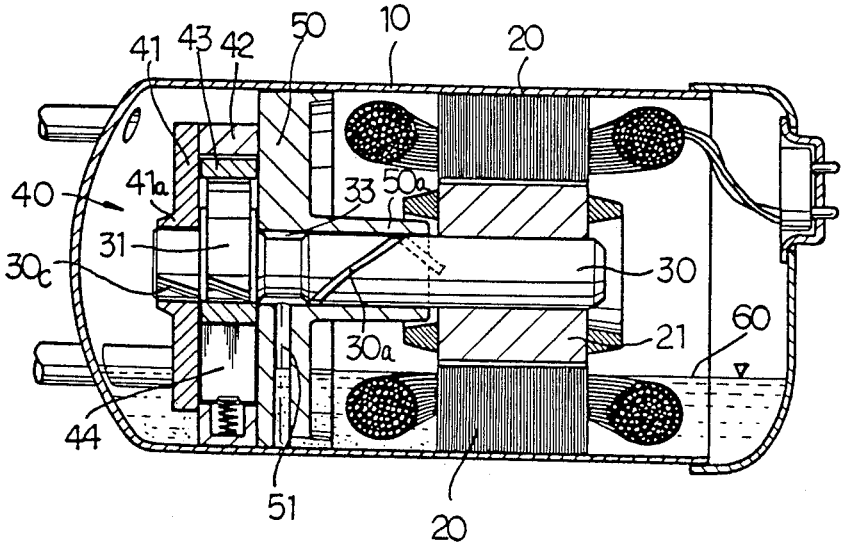
FIG. 1 is a vertical sectional view of one embodiment of the rotary compressor in accordance with the present invention.
Figure 2:
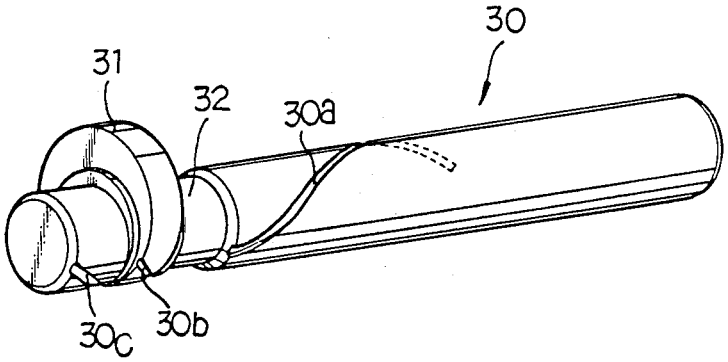
FIGS. 2 and 3 are perspective views of the cam shaft in accordance with the present invention.

As shown in FIG. 1, basically, for the sake of fulfillment of the present invention, within a casing(10) of a rotary compressor, an electric motor comprising a stator (20), a rotor(21) and a shaft(30) is horizontally disposed and also a frame(50) integrally formed with a journal-bearing for supporting horizontally the said shaft(30) and a compression section(40) actuated by said shaft(30) for compressing refrigerant are also disposed in the casing(10). The said compression section(40) positioned by one side of the said frame(30) comprises a circular rolling piston(43), a cylinder(42) thereof, a cylinder block(41) provided with a sub-bearing(41*a*) on which one end of the shaft(30) slides, a blade(44) supported by a spring at one side of said cylinder(42) and an eccentric cam formed around the shaft(30), on which said rolling piston(43) is mounted. All the aforesaid elements are basically requisite for an ordinary horizontal type rotary compressor. An oil flow passage(51) is formed inside the frame to extend from the inner periphery of the journal-bearing(50*a*) to the lower end of the frame(50) and an annular space(33) is formed between the journal bearing(50*a*) and the shaft(30) to communicate with the oil flow passage(51).

The annular space (33) may be formed by providing a small diameter portion (32) either on the periphery of shaft (30) or by means of a circular channel (not shown) on the inner periphery of the journal bearing (50*a*).

Figure 3:
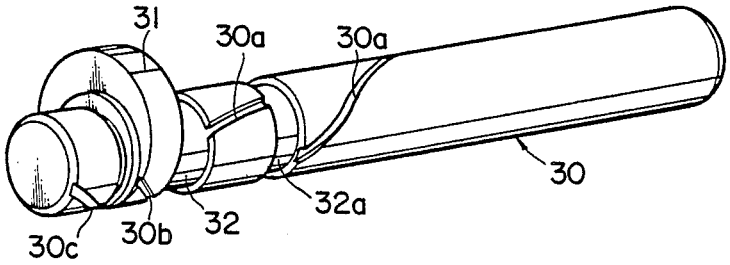

Furthermore as shown in FIG. 3 herein, an additional small diameter portion may be formed around a middle part of the sliding portion of the shaft. In addition to this, oil grooves(30*a*)(30*b*)(30*c*) are formed on the periphery of the shaft(30) over the whole sliding portion thereof from the journal-bearing(50*a*) to sub-bearing(-41*a*) so as to communicate with the annular space(33). Accordingly, the said oil flow passage(51) and the annular space(33) can communicate with the ambient space outside the sliding portion of the shaft.

Figure 4:
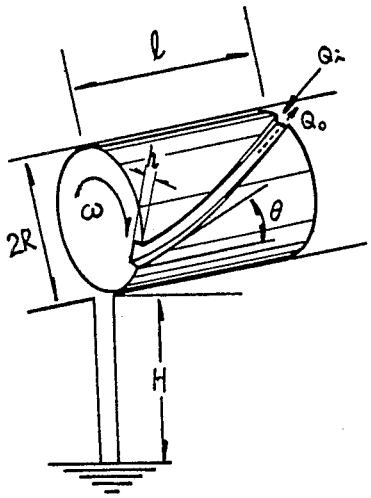
FIG. 4 is a perspective view schematically showing a portion of the shaft provided with a spiral oil groove having a certain depth in accordance with the present invention.
Figure 5:
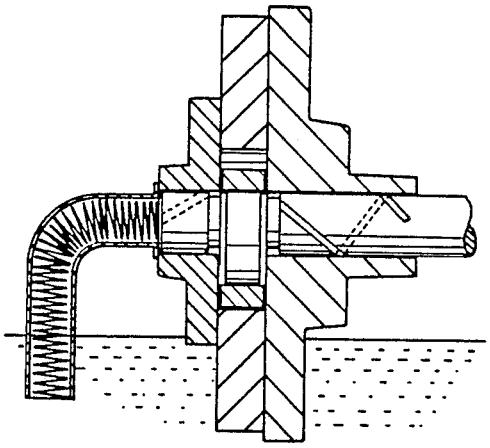
FIG. 5 PRIOR ART
FIGS. 5 to 7 are vertical partial sections schematically showing conventional oil feeding means.
Figure 6:
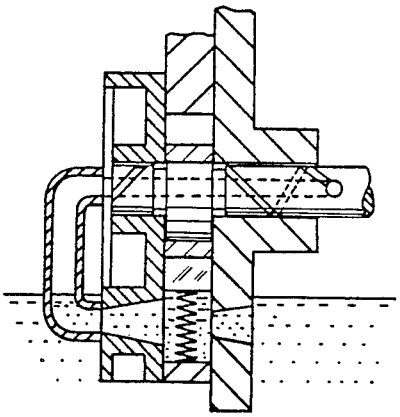
FIG. 6 PRIOR ART
Figure 7:
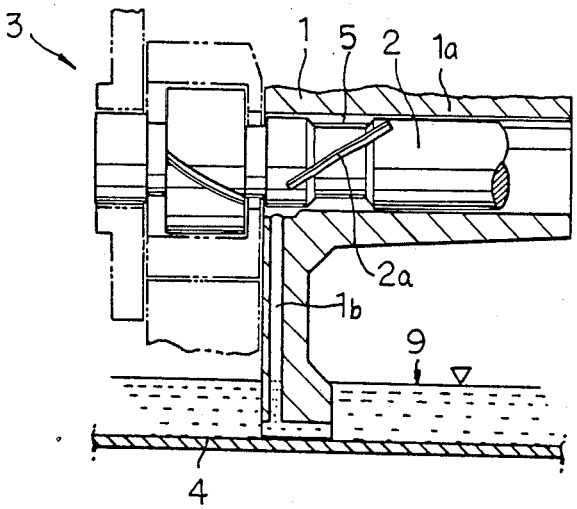
FIG. 7 PRIOR ART

The depth of the grooves should be limited within the certain value as aforementioned in order that the refrigerant stored within the oil grooves(30*a*)(30*b*)(30*c*) flows out to the ambient space from the sliding portion overcoming the increasing pressure within the casing, and then the lubricant in the lower part of the casing is sucked to the oil grooves(30*a*)(30*b*)(30*c*) via the oil flow passage(51) and the circular space(33). More details will be described as follows. When the compressor unit is initially in a rest state, the upper vacancy of said oil flow passage(51) and the annular space(33) formed between said journal-bearing and the shaft (30) is filled with the refrigerant. At this time, the pressure of said spaces between the sliding portions and that of the outside of the sliding portions (that pressure within the casing) remain almost the same. As the compressor unit starts and the shaft(30) rotates at high speed, said refrigerant within the spaces must be forced to flow out from the sliding portion via the spirally formed oil grooves(-30*a*)(30*b*)(30*c*). To this end, in the present invention, the oil grooves are intended to function as a blade to make the refrigerant flow out and, accordingly to induce a relatively low pressure within the sliding portions so that the oil may be supplied to the sliding portions through oil passage (51), to cause the lubricant(60) to be pumped up and be supplied to the sliding portion of the shaft via the oil flow passage(51) and the annular space(33). Since the pressure within the casing is, however, increased sharply upon the operation of the compressor, an inverse force is created which forces the refrigerant to flow reversely through the oil grooves. This is due to the pressure difference. Should the pressure which causes the refrigerant to flow in reverse be larger than the pressure which is produced by the movement of said grooves to push the refrigerant outwardly from the sliding portions, it will be impossible to cause the refrigerant to flow in the desired direction. For this reason, in the present invention, the depth of the said oil grooves is limited within a certain value in view of the laminar flow phenomenon due to the viscosity of the refrigerant so that the pressure difference ($\Delta P$) required for raising the lubricant up to the certain distance(H) may be obtained before the pressure by the inertial force of the refrigerant due to the rotation of the shaft becomes lower than the inverse pressure within the casing. Referring to FIG. 4, the pressure difference, $\Delta p$, due to the flow of the refrigerant in the grooves should be larger than $\rho gH$ in order to raise the lubricant up to the distance H where $\rho$ is the density of the lubricant, g is the acceleration of gravity and H is the distance from the suruface of the lubricant to the sliding surface of the bearing. Since the shaft is rotated relative to the bearings, the flow of the refrigerant due to the rotating shaft may be considered as being the laminar flow between two parallel plates one of which moves in a constant speed while the reverse flow of the refrigerant by the increased pressure inside the casing may be considered as being the laminar flow between two stationary parallel plates.

Figure 8:
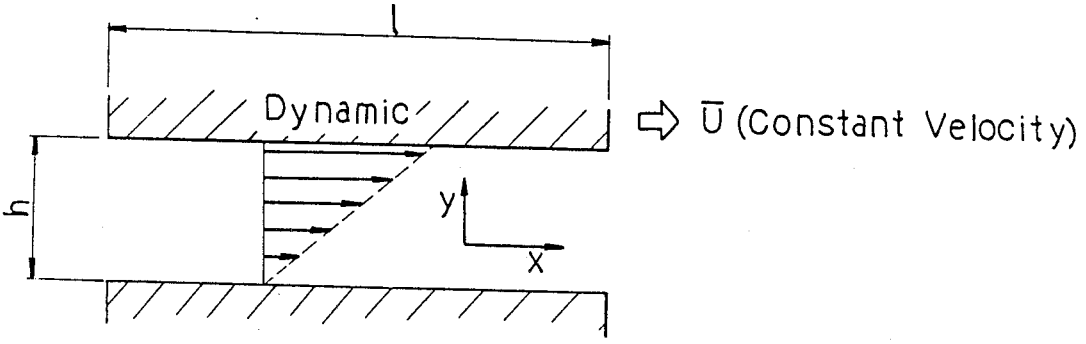
FIG. 8 is a schematic illustration showing the laminar flow when air infinite plate moves parallel to a second infinite plate which is fixed; the moving plate moving at a constant velocity and distance explains the phenomena of the refrigerant within the sliding portion as it flows out the outside of the sliding portion due to the inertia force caused by the rotation of the shaft.

The above-mentioned descriptions can be expressed by the following equations. The flow of the refrigerant due to inertial force may be considered as a laminar flow between a stationary plate and a plate moving at a constant speed and distance with respect to the stationary plate. This situation is depicted in FIG. 8. In this situation, the shear stress ($\tau yx$) on a plane normal to the Y axis in the direction of the X axis can be expressed as follows.

$$\tau yx = \left(\frac{d\rho}{dx}\right)y + C_1 \tag{1}$$

where

P=pressure and $$\tau yx = \mu\left(\frac{du}{dy}\right) \tag{2}$$

where $\mu$=velocity in the direction of the $\chi$ axis.

Equating Eq(1) and Eq(2)

$$\mu\frac{du}{dy} = \left(\frac{d\rho}{dx}\right)y + C_1 \tag{3}$$

Integration produces $$u = \frac{1}{2\mu}\left(\frac{d\rho}{dx}\right)y^2 + \frac{C_1}{\mu}y + C_2 \tag{4}$$

substituting the values of the boundary condition i.e.

$u = 0$ at $y = 0$ or $u = \pi$ at $y = a$ into Eq(4)

$$u = \frac{\pi y}{h} + \frac{h^2}{2\mu}\left(\frac{d\rho}{dx}\right)\left[\left(\frac{y}{x}\right)^2 - \left(\frac{y}{h}\right)\right] \tag{5}$$

where pressure $\rho$=constant.

Thus $$u = \frac{\pi y}{h} \tag{6}$$

The flowing quantity is $$Q = \int_o^h \rho'\pi Dy\mathrm{d}y \tag{7}$$

and $$Q = \frac{\pi dh}{2} \tag{8}$$

where $\pi$ is a velocity component in the direct of the groove.

Therefore $$\pi = \omega R\cos\theta \tag{9}$$

where $\omega$=angular velocity of shaft

R=radius of shaft $\theta$=angle between the direction of the groove and the axis of the shaft.

Thus the quantity of the refrigerant per unit time ($Q_0$) which flows out through the groove due to the inertial force is expressed by a general formula as follows;

$$Q_0 = \frac{\rho'\omega Rhd}{2}\cos\theta \tag{10}$$

where $\rho'$=density or refrigerant h=depth of groove d=width of groove.

Figure 9:
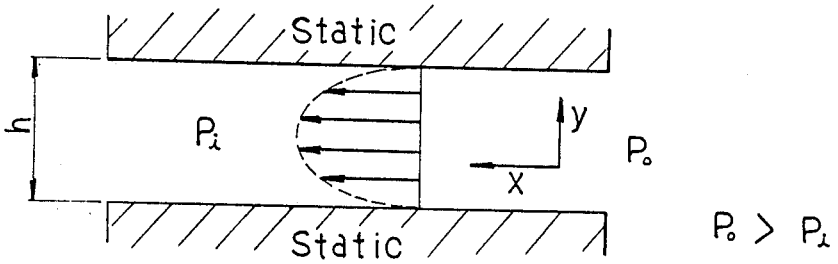
FIG. 9 is a schematic illustration of the laminar flow which occurs due to pressure variations when fluid flows between two fixed infinite planes placed at a certain distance from each other and explains the phenomena of the refrigerant flowing into the sliding portions due to a pressure difference.

On the other hand, after the actuation of the compressor, the inverse flow of the refrigerant caused by the pressure difference between the pressures of the inside and the outside of the sliding portion may be considered as a laminar flow formed simply by the pressure variations between two static plates. This is situation is depicted in FIG. 9. Substituting values of the boundary condition in this case, i.e. u=0 at y=0 or u=0 at y=h into equation 4, we get the following.

$$u = \frac{h^2}{2\mu}\left(\frac{d\rho}{dx}\right)\left[\left(\frac{y}{h}\right)^2 - \left(\frac{y}{h}\right)\right] \tag{11}$$

The quantity of the reversely flowing refrigerant per unit time(Qi) can be derived from Eq(11) as follows;

$$Qi = \frac{\rho' h^3}{12\mu}\cdot d\left(\frac{d\rho}{dL}\right)\sin\theta \tag{12}$$

where $\mu$=viscosity of refrigerant

L=total length of the shaft where the grooves are formed.

Figure 10:
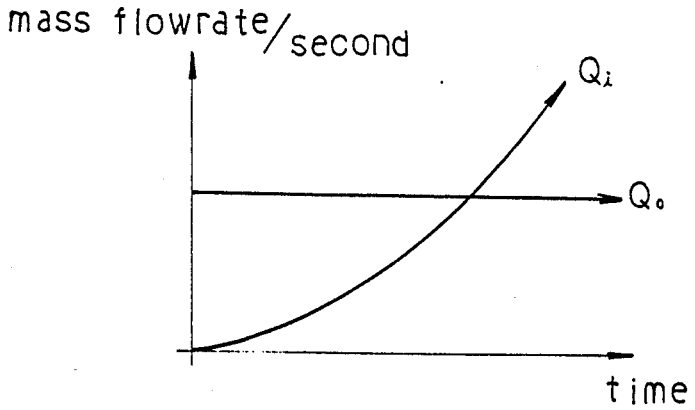
FIG. 10 is a diagram showing the outflow and the inflow in relation to the passage of time after actuation of the compressor.

According to equation 10 and equation 12, while the outflow of the refrigerant (Q0) due to the initial force is constant, the inflow of the refrigerant (Qi) is gradually increased by the pressure difference ($d\rho$) between the inside and the outside pressures of the sliding portions, which increases upon the actuation of the compressor. This is shown in FIG. 10.

The reason why the outflow and the inflow of the refrigerant are expressly separate equations is to facilitate the analysis of the phenomena which occurs instantaneously on certain boundary surfaces; that is to say, the tendency for the refrigerant to flow outwardly and the reverse tendency for the refrigerant to flow inwardly due to pressure differences. At the beginning of the actuation of the compressor, the fact that the refrigerant may easily flow outwardly of the sliding portions is due to the fact that there is not any pressure difference to cause the refrigerant to flow inwardly. However, when the inward pressure exceeds the outward pressure the refrigerant will flow inwardly. The object of the present invention is therefore to obtain at least the pressure difference ($\Delta P$) between the inside and the outside of the sliding portions that enables the oil up to be raised up to the sliding portions before the force to move the refrigerant outwardly becomes less than the force to cause it to flow inwardly. As shown in FIG. 10, before the outflow of refrigerant (Q0) becomes equal to the inflow of the refrigerant (Qi), the above-mentioned pressure difference should be obtained. Therefore equating equation 10 and equation 12 we get the following.

$$\frac{d\rho}{dL} = \frac{6\mu\omega R}{h^2}\cot\theta \tag{13}$$

Eq(13) can be written for the pressure difference($\Delta\rho$)

$$\Delta\rho = \frac{6\mu\omega R}{h^2}\cot\theta\cdot L \tag{14}$$

In equation 14, necessary at the point where the outflow (Q0) and the inflow (Qi) of the refrigerant reaches an equilibrium state is the pressure difference ($\Delta P$ grows) and the point at least by which the oil can be raised up to the sliding portions. Therefore, the least pressure difference ($\Delta P$) required for raising the oil up to the sliding portion is $$\Delta\rho \geqq \rho g H \tag{15}$$

where $\rho$=density of oil g=acceleration of gravity

H=height from the surface of the oil to the sliding portions.

Substituting equation 15 into equation 14 produces a general equation concerning the depth of the oil groove. That equation is $$h \leqq \left(\frac{6\mu\omega R}{\rho g H}\cdot\cot\theta\cdot L\right)^{\frac{1}{2}} \tag{16}$$

In accordance with the present invention the depth of the grooves (h) can be determined by the general equation expressed in equation 16 according to the conditions of various variables such as the radius of the shaft (R), the angular velocity of the shaft (w). The angle between the direction of the grooves and the axis of the shaft ($\theta$) and the total length of the shaft where the grooves are formed (L).

Once the oil is supplied to the sliding portions, as mentioned above, the incompressible oil can be continuously supplied. However, the width of the grooves (d) as a variable is excluded in the above equation because it is offset in the course of driving the equation. Thus, as shown in the above equation, the width of the grooves cannot act as a variable to raising the oil from the oil sump to the groove and preventing the reverse flow of the oil. The width of the grooves can be varied to control the flowing quantity and consequently to enable the rapid supply of the oil supply to the sliding portions.

Since it is desirable to supply the oil to the sliding portions as quickly as possible, the width of the grooves may be widened as required. However if the width of the grooves is too wide, the pressure and susceptibility of abrasion on the sliding surface will be increased. Therefore it is desirable to control the width of the grooves. Furthermore, and as shown in FIG. 3, an additional small diameter portion (32*a*) may be formed around a middle part of the sliding portion of the shaft for holding a cetain amount of the lubricating oil. This oil will flow through the grooves to supply sufficient lubrication to the sliding portions of the shaft (30).

According to the inventor's experiments in relation to the above mentioned equations, the following results of the compressor units for the domestic refrigerator were gained.

| Sample No. | Depth(h) of Groove | Rising Distance(H) of Lubricant |
|---|---|---|
| 1 | 0.5 mm | 0 mm |
| 2 | 0.3 mm | 10 mm |
| 3 | 0.1 mm | Above 42 mm |

Accordingly, the lubricant can be delivered to the sliding portion in a shorter time. Furthermore, as shown in FIG. 3, the shaft is provided with a small diameter portion at the middle of the sliding portion for reserving sufficient amount of the lubricant in order to lubricate more effectively the sliding portion.

What is claimed is:

1. An oil feeding means incorporated in a horizontal type rotary compressor unit which comprises, in a casing, a lubricant reservoir retaining the lubricating oil, a compression section, a horizontal disposed electric motor and a frame incorporating a journal-bearing in the middle thereof for supporting the shaft of the electric motor directly connected to the said compression section, an oil flow passage which is formed inside the said frame and the lower part of which extends below the surface of the oil, an annular space formed between the journal-bearing and the shaft to communicate with the said oil flow passage and oil supply grooves formed on the periphery of the shaft to communicate with the annular space, characterized in that the said oil supply grooves extend to the outside of the sliding portion of the axis to be exposed to the casing and the depth of the oil supply grooves is limited below the value, h, represented by the following relationship, $$h = \left( \frac{6\mu\omega R}{\rho g H} \cdot \cot\theta \cdot L \right)^{\frac{1}{2}}$$

where $\mu$=viscosity of refrigerant $\omega$=angular velocity of shaft

R=radius of shaft $\rho$=density of lubricant g=acceleration of gravity

H=distance from surface of lubricant to sliding surface of journal-bearing $\theta$=angle between groove and axial line of shaft L=total length of shaft where grooves are formed.

2. A horizontal type rotary compressor as claimed in claim 1 wherein an additional small diameter portion is provided in the middle of the portion sliding in said journal bearing of the shaft.

3. A horizontal type rotary compressor comprising a casing having an oil sump in the bottom thereof;

a compression section defined in said compressor;

a horizontally disposed electric motor having a shaft;

a frame incorporating a journal bearing in the middle thereof, said journal bearing acting to support the shaft of said motor, said shaft being operable to actuate said compression section;

an oil flow passage defined vertically in said frame and having a lower part which opens into said oil sump, said journal bearing and said shaft defining therebetween an annular space, said annular space communicating with said oil flow passage; and helical oil supply grooves defined in the periphery of said shaft and communicating with said annular space, said compressor being characterized in that said oil supply grooves extend around that portion of said shaft which slides in said journal bearing and opening into said casing, the depth of said oil supply grooves being limited to a value below that of (h) represented in the following relationship:

$$h = \left( \frac{6\mu\omega R}{\rho g H} \cdot \cot\theta \cdot L \right)^{\frac{1}{2}}$$

where $\mu$=viscosity of refrigerant $\omega$=angular velocity of the shaft

R=radius of the shaft $\rho$=density of lubricant g=acceleration of gravity

H=distance from the surface of lubricant to the sliding surface of the journal-bearing $\theta$=angle between groove and axial line of shaft L=total length of shaft where grooves are formed.

4. A horizontal type rotary compressor as claimed in claim 3 further comprising an additional small diameter portion defined generally centrally of the portion of said shaft that slides in said journal bearing, said small diameter portion acting to receive said oil and lubricate the portions of said shaft which slide in said bearing.

* * * * *